US012752205B2

(12) United States Patent
Fan

(10) Patent No.: US 12,752,205 B2
(45) Date of Patent: Oct. 6, 2026

(54) DOLL EYE WITH A CHANGEABLE PUPIL STRUCTURE

(71) Applicant: Dongguan Hi Chance Toys Co., Ltd., Dongguan City (CN)

(72) Inventor: ZhiSong Fan, Dongguan City (CN)

( * ) Notice: Subject to any disclaimer, the term of this patent is extended or adjusted under 35 U.S.C. 154(b) by 0 days.

(21) Appl. No.: 19/361,575

(22) Filed: Oct. 17, 2025

(65) Prior Publication Data

US 2026/0042028 A1 Feb. 12, 2026

(51) Int. Cl.
*A63H 3/40* (2006.01)

(52) U.S. Cl.
CPC ..... *A63H 3/40* (2013.01)

(58) Field of Classification Search
CPC ..... A63H 3/38; A63H 3/40
USPC ..... 446/341, 343, 344
See application file for complete search history.

(56) References Cited

U.S. PATENT DOCUMENTS 1,721,369 A * 7/1929 Beyler ..... A63H 3/40 446/342
1,772,282 A * 8/1930 Grubman ..... A63H 3/40 446/344
1,809,053 A * 6/1931 Marcus ..... A63H 3/40 446/349
2,657,500 A * 11/1953 Samolewitz ..... A63H 3/40 446/348
2,954,639 A * 10/1960 Walss ..... A63H 13/005 446/338
3,287,848 A * 11/1966 Katz ..... A63H 3/40 446/338
3,757,465 A * 9/1973 Barlow ..... A63H 3/40 446/341
4,393,619 A * 7/1983 Murch ..... A63H 3/42 446/392
7,641,535 B2 * 1/2010 Maddocks ..... A63H 3/42 446/342
11,170,667 B2 * 11/2021 Kirchhoff ..... G09B 23/32
11,931,666 B2 * 3/2024 Todo ..... B25J 11/0015
2008/0293325 A1 * 11/2008 Lei ..... A63H 3/40 446/343
2010/0029171 A1 * 2/2010 Su ..... A63H 3/38 446/392

* cited by examiner

*Primary Examiner* — Kurt Fernstrom
(74) *Attorney, Agent, or Firm* — Che-Yang Chen; Law Office of Michael Chen

(57) ABSTRACT

A doll eye with a changeable pupil structure includes an eye component, a doll face component, and a bottom housing, the eye component further comprises two eyeballs, each of the eyeball includes three first openings equidistantly formed on its surface, and each of the first opening is internally provided with a pupil component capable of expressing different eye expressions. The present invention provides three first openings equidistantly formed on each of the surface of the eyeball, and each of the first opening internally has a pupil component capable of expressing different eye expressions, so that the doll eye can present a variety of different eye expressions by rotating the eye component, more realistically simulating the activity of the human eye, thereby increasing the fun and interactivity of the doll, and improving the simulation and aesthetics of the doll.

6 Claims, 5 Drawing Sheets

DOLL EYE WITH A CHANGEABLE PUPIL STRUCTURE

FIELD OF THE INVENTION

The present invention relates to the technical field of doll accessories, in particular to a doll eye with a changeable pupil structure.

BACKGROUND OF THE INVENTION

Existing doll eyes are usually made by printing or spraying, and their eye expressions are single and cannot be changed. Although some doll eyes with changeable eyes have appeared on the market, their structures are complex, the production process is cumbersome, the cost is high, and it is not conducive to mass production. In addition, the eyeballs of existing changeable doll eyes are usually fixed to the doll face, making the eyeballs unable to rotate, and the eye expression change effect is not realistic enough, which affects the overall beauty and fun of the doll.

To solve the above-mentioned problems, although there are some existing rotatable doll eyeball structures, most of them use complex gear transmission mechanisms or motor drives, resulting in complex structures, difficult assembly, and high costs. Furthermore, existing rotatable eyeball structures suffer from poor connection stability between the eyeball and the doll face, making it prone to fall off or shift in positions, affecting the lifespan and aesthetics. Therefore, it would be highly practical to provide a doll eye with a simple structure, easy manufacturing process, low cost, and capable of expressing different eye expressions.

SUMMARY OF THE DISCLOSURE

In view of this, the present invention provides a doll eye with a changeable pupil structure to solve the problems raised by the above-mentioned background.

In order to achieve the above purpose, The present invention provides the following technical solutions: a doll eye with a changeable pupil structure, comprising an eye component, a doll face component, and a bottom housing, wherein the eye component further comprises two eyeballs, each of the eyeball is provided with three first openings equidistantly formed on its surface, each of the first opening is internally provided with a pupil component capable of expressing different eye expressions, each of the pupil component further comprises an iris column disposed inside the first opening, one end of the iris column is printed with iris patterns and a glass cover that is tightly covered inside the first opening, and the two eyeballs are fixedly connected by a penetrating rotating shaft; the surface of the doll face component is provided with two second openings in an eye area, the two second openings are respectively sleeved on an outside of the two eyeballs, and the doll face component is clamping connected with the rotating shaft through a clamping mechanism;

As a preferred embodiment of the present invention, a bottom housing is buckled and connected to a bottom of the doll face component.

As a preferred embodiment of the present invention, the iris column is opened with an insertion hole at the other end, and the insertion hole is fixedly connected to a insertion protrusion at a bottom of each of the first opening.

As a preferred embodiment of the present invention, the diameters of two ends of the rotating shaft are different.

As a preferred embodiment of the present invention, the clamping mechanism further comprises three first support bases fixedly connected to an interior of the doll face component, each first support base is provided with a first arc-shaped clamping groove, the rotating shaft is connected with the three first arc-shaped clamping grooves of the corresponding first support bases, the interior of the doll face component is fixedly connected with three triangularly distributed positioning columns, one end of the three positioning columns is provided with a pressure plate, one side of the pressure plate is fixedly connected with three second support bases, each second support base is provided with a second arc-shaped clamping groove, the second arc-shaped clamping grooves are positioned opposite to the first arc-shaped clamping grooves and are clamping connected with the rotating shaft, one side of the pressure plate is fixedly connected with three plug pins, and the plug pins are fixedly plugged into one end of the positioning columns.

As a preferred embodiment of the present invention, two T-shaped holes are provided on two sides of a bottom of the bottom housing, and two T-shaped holes are matched with two T-shaped plug pieces fixedly connected to a bottom of the doll face component at ears position.

As a preferred embodiment of the present invention, a hemispherical protrusion is provided on each surface of the glass cover.

Compared with the prior art, the present invention has the following beneficial effects:

The present invention provides three first openings equidistantly formed on each of the surface of the eyeball, and each of the first opening is internally provided with a pupil component capable of expressing different eye expressions, so that the doll eye can present a variety of different eye expressions by rotating the eye component, more realistically simulating the activity of the human eye, thereby increasing the fun and interactivity of the doll, and improving the simulation and aesthetics of the doll. Moreover, the eye component provides two fixedly connected two eyeballs through a rotating shaft, and the eye component is detachably connected to the doll face component through a clamping mechanism, which not only achieves the rotation of eyeballs on the doll face, but also facilitates the assembly of eye component, reducing the production cost of dolls. In addition, the rotating shaft provides different diameters at two ends and is clamping connected with multiple support bases, which provides a simple structure, prevents the incorrect assembly of the eye component, and prevents the eyeballs from falling off or shifting in position.

The iris columns of the present invention is connected to the bottom of the corresponding first openings by inserting, and the glass covers are tightly covered on the top of the corresponding first openings, making the installation of the pupil components more convenient and quick, and improving the connection stability between the pupil components and the eyeballs. In addition, a hemispherical protrusion is provided on each surface of the glass cover, which can magnify the iris patterns, making the doll eye more vivid and beautiful, thereby improving the product competitiveness in the market.

DETAILED DESCRIPTION OF THE PREFERRED EMBODIMENTS

Figure 1:
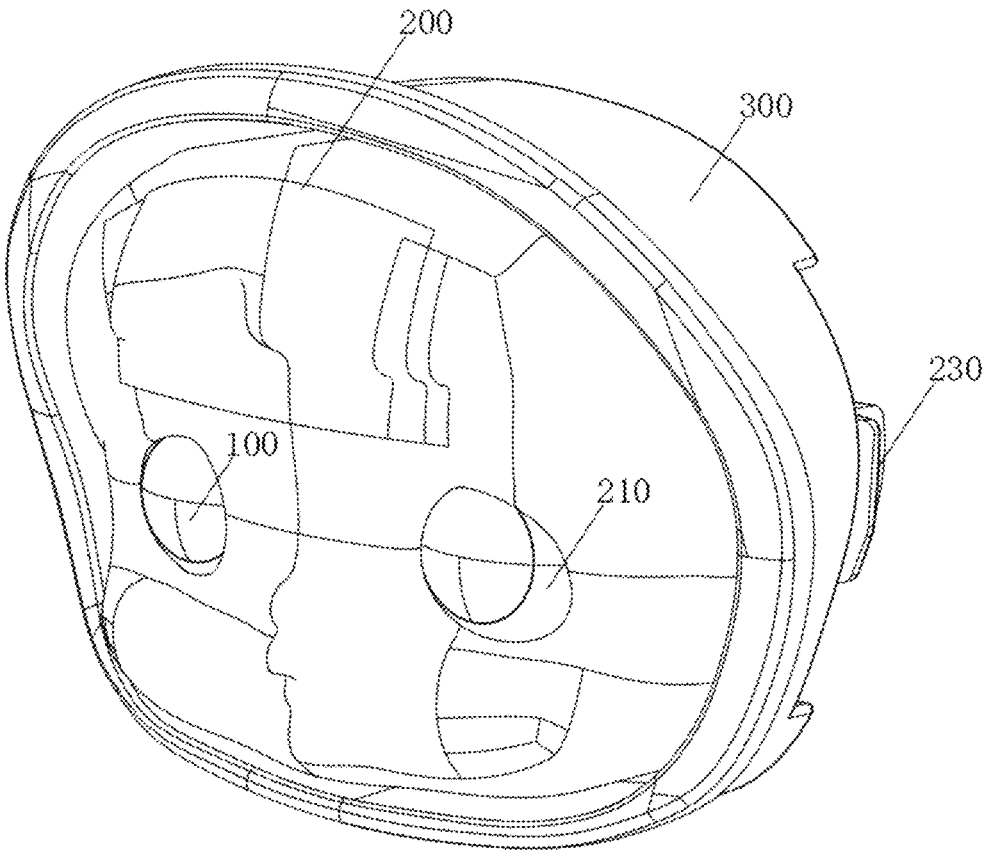
FIG. 1 is a perspective of the present invention.
Figure 2:
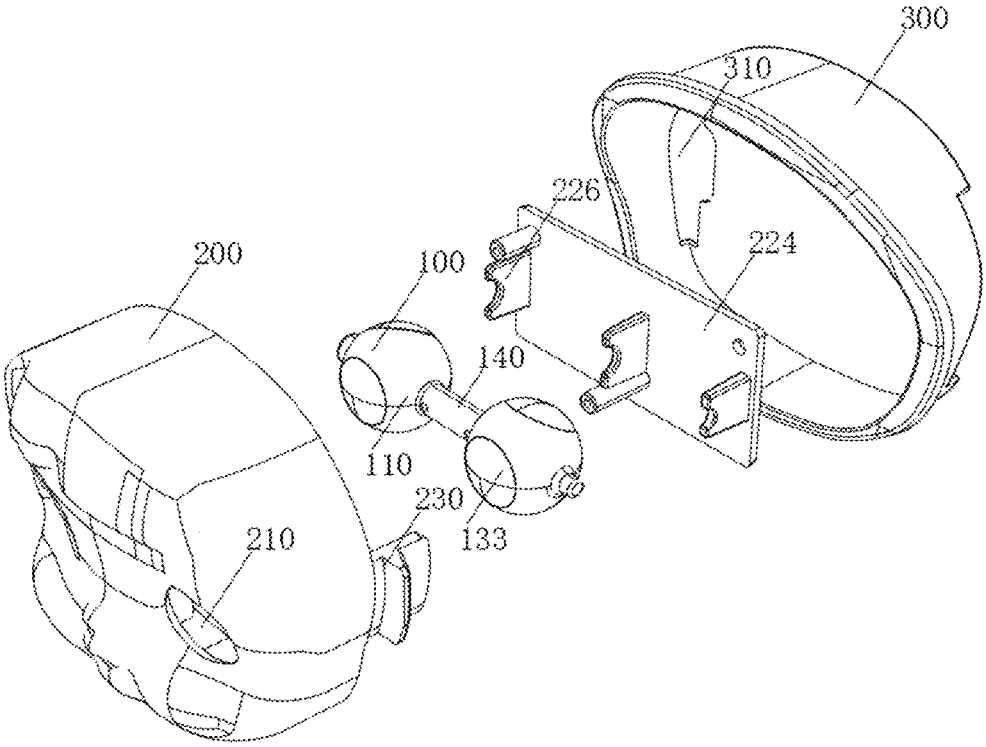
FIG. 2 is an exploded view of the present invention.
Figure 3:
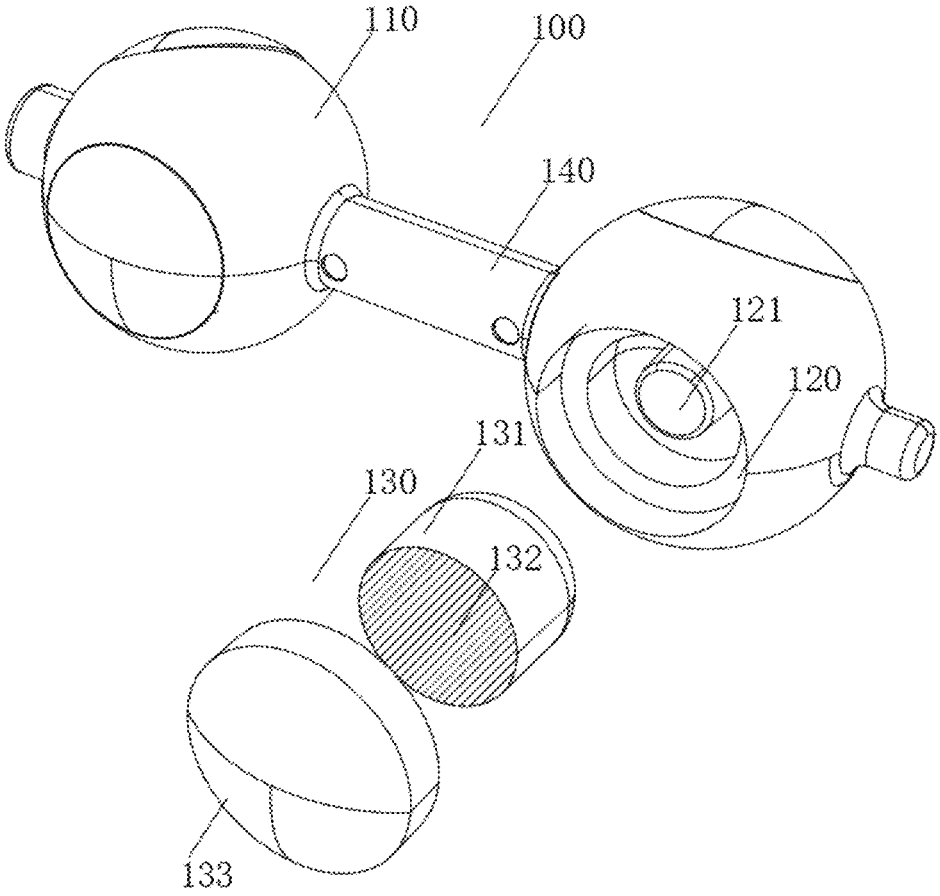
FIG. 3 is a schematic view of the eye component structure of the present invention.
Figure 4:
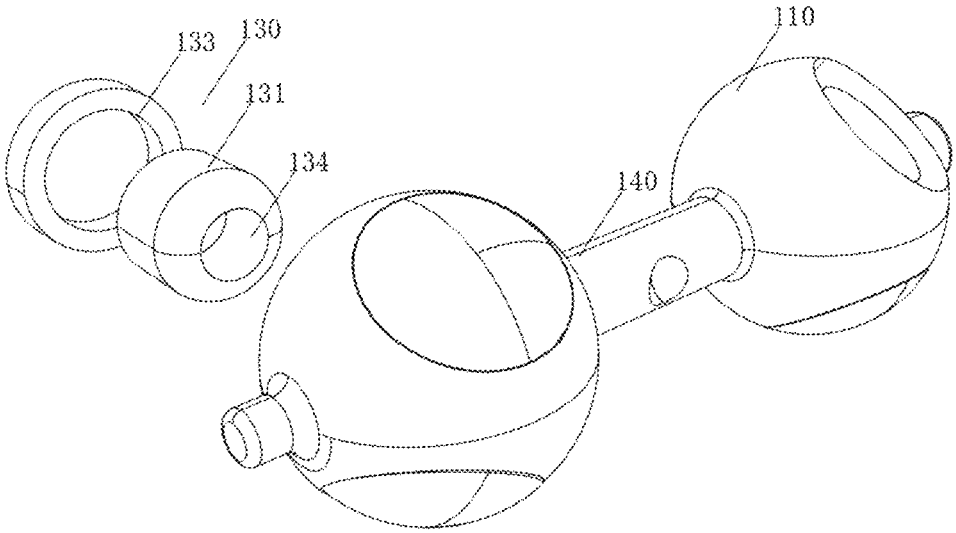
FIG. 4 is a schematic view of the eye component structure of the present invention.
Figure 5:
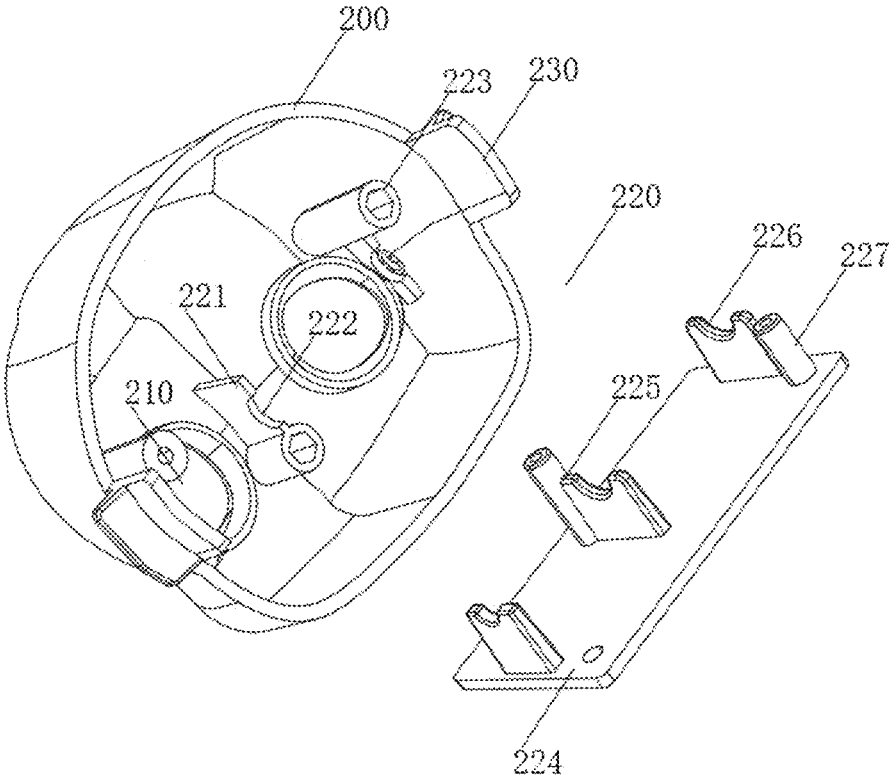
FIG. 5 is a schematic structural view of the clamping mechanism of the present invention.

Other features, objects and advantages of the present invention will be more clearly and completely by the detailed description of the non-limiting embodiments with reference to the attached drawings (FIG. 1 to FIG. 5). Obviously, the described embodiments are only part of the embodiments of the present invention, but not all of them. Based on the embodiments of the present invention, all other embodiments obtained by ordinary technicians in the field without creative labor are within the scope of the present invention.

Referring to FIGS. 1-5, the present invention provides a doll eye with a changeable pupil structure, comprising an eye component 100, a doll face component 200, and a bottom housing 300; the eye component 100 further comprises two eyeballs 110, each of the eyeball 110 is provided with three first openings 120 equidistantly formed on its surface, and each of the first opening 120 is internally provided with a pupil component 130 capable of expressing different eye expressions; each of the pupil component 130 further comprises an iris column 131 disposed within the first opening 120, one end of the iris column 131 is printed with iris patterns 132 and one end of the iris column 131 is further provided with a glass cover 133 that is tightly covered inside the first opening 120, and the two eyeballs 110 are fixedly connected by a rotating shaft 140 that penetrating through them; the surface of the doll face component 200 is provided with two second openings 210 disposed in the eye area, the two second openings 210 are respectively sleeved on an outside of the two eyeballs 110, and the interior of the doll face component 200 is clamping connected with the rotating shaft 140 through a clamping mechanism 220; the said bottom housing 300 is buckled and connected to the bottom of the doll face component 200.

Specifically, three first openings 120 are equidistantly formed on each of the surface of the eyeball 110, each of the first opening 120 is provided with a pupil component 130 printed with different iris patterns 132, so that the doll eye can present a variety of different eye expressions by rotating the eye component 100. When the two eyeballs 110 are rotated, different pupil components 130 will appear in sequence at the second openings 210 of the doll face component 200, thereby achieving at least three eye expression changing effects.

The two eyeballs 110 are fixedly connected by a rotating shaft 140 that passing them, so that the two eyes can rotate synchronously, more realistically simulating the activity of the human eye. Through the cooperation of the rotating shaft 140 and the clamping mechanism 220 inside the doll face component 200, the eye component 100 is detachably connected to the doll face component 200, which not only facilitates assembly and maintenance, but also improves the connection stability between the eye component 100 and the doll face component 200, preventing the eyeballs 110 from falling off or shifting in position.

The bottom housing 300 is buckled and connected with the doll surface component 200, which further improves the stability of the overall structure of the doll, and facilitates the production, assembly, disassembly and maintenance of the doll.

In this embodiment, each of the iris column 131 is opened with an insertion hole 134 at the other end, and the insertion hole 134 is fixedly connected to a insertion protrusion 121 at the bottom of each of the first opening 120.

Specifically, by providing an insertion hole 134 on each of the iris column 131 at the other end and being connected with the insertion protrusion 121 at the bottom of each of the first opening 120, the pupil components 130 can be firmly inserted and fixed on the eyeballs 110, thereby improving the connection stability between the pupil components 130 and the eyeballs 110, and preventing the pupil components 130 from falling off or shifting in position during the rotation of the eyeballs 110.

The glass cover 133 at the upper of the iris column 131 is tightly covered inside the first opening 120, which not only protects the iris patterns 132, but also makes the color of the iris patterns 132 more vivid and bright due to the light transmittance of the glass material, thereby improving the beauty and simulation of the doll eye.

The iris column 131 is connected by the insertion protrusion 121 and the insertion hole 134, making the installation of the pupil component 130 more convenient and quick, without the need for auxiliary materials such as glue, thereby reducing production costs and improving the environmental performance of the doll.

In this embodiment, the diameters at two ends of the rotating shaft 140 are different.

Specifically, by designing the two ends of the rotating shaft 140 to different diameters, a matching relationship similar to that of a bearing and a sleeve is formed, thereby improving the connection stability between the rotating shaft 140 and the two eyeballs 110, and the rotation flexibility between the rotating shaft 140 and the clamping mechanism 220, effectively preventing the eyeballs 110 from shifting or falling off during rotation. Moreover, the design of the different diameters at two ends of the rotating shaft 140 can also prevent the incorrect assembly of the eye component 100, thereby improving the efficiency and accuracy of the doll production and assembly. In addition, the integrated design of the rotating shaft 140 and the two eyeballs 110 also reduces the production cost of the doll, simplifies the assembly steps, and improves the production efficiency of the doll.

In this embodiment, the clamping mechanism 220 further comprises three first support bases 221 fixedly connected to the interior of the doll face component 200, each first support base 221 is provided with a first arc-shaped clamping groove 222 at one end, the two ends and the middle part of the rotating shaft 140 is connected with the three first arc-shaped clamping grooves 222 of the corresponding first support bases 221, the interior of the doll face component 200 is fixedly connected with three triangularly distributed positioning columns 223, one end of the three positioning columns 223 is provided with a pressure plate 224, one side of the pressure plate 224 is fixedly connected to three second support bases 225, each second support base 225 is provided with a second arc-shaped clamping groove 226 at one end, the second arc-shaped clamping grooves 226 are positioned opposite to the first arc-shaped clamping grooves 222 and are connected with the rotating shaft 140, one side of the pressure plate 224 are fixedly connected with three plug pins 227, and the plug pins 227 are fixedly plugged into the holes at one end of the positioning columns 223.

Specifically, three triangularly distributed first support bases 221 are fixedly connected to the interior of the doll face component 200. Through the cooperation of the first arc-shaped clamping grooves 222 on the first support bases 221 and the second arc-shaped clamping grooves 226 of the second support bases 225 on the pressure plate 224, the oppositely disposed arc-shaped clamping grooves can be used to clamp the two ends and the middle part of the rotating shaft 140, thereby supporting and fixing the rotating shaft 140, ensuring that the rotating shaft 140 can rotate normally and not falling off. Through the cooperation of the three plug pins 227 on the pressure plate 224 and the holes on the positioning columns 223, the pressure plate 224 is firmly fixed to the positioning columns 223, which not only avoids the problem of the pressure plate 224 falling off or shifting in position during use, but also eliminates the need for auxiliary fixing parts such as screws or glue for the assembly of the eye component 100 and the doll face component 200.

In this embodiment, T-shaped holes 310 are provided on two sides of the bottom of the bottom housing 300, the two T-shaped holes 310 are matched with two T-shaped plug pieces 230 fixedly connected to the bottom of the doll face component 200 at the position of the two ears.

Specifically, by providing T-shaped holes 310 on two sides of the bottom of the bottom housing 300 and the T-shaped plug pieces 230 fixedly connected to the bottom of the doll face component 200 at the position of the two ears, the bottom housing 300 can be fixedly connected to the doll face component 200, thereby improving the stability of the overall structure of the doll, and making the assembly of the bottom housing 300 and the doll face component 200 simple and convenient without the use of tools or auxiliary materials.

In this embodiment, a hemispherical protrusion is provided on each surface of the glass cover 133.

Specifically, by providing the hemispherical protrusion, the glass cover 133 is provided with the effect of a magnifying glass, and can magnify the iris patters 132, making the doll eye more vivid and beautiful, thereby improving the product competitiveness in the market.

Hereinafter, embodiments of the present invention have been described in detail with reference to the accompanying drawings. While the description above refers to the particular embodiments of the present invention, it will be understood that many modifications may be made without departing from the spirit thereof. Any equivalent replacement or modification would fall within the protection scope of the present invention.

What is claimed is:

1. A doll eye with a changeable pupil structure, comprising:

an eye component (100), wherein the eye component (100) further comprises two eyeballs (110), each of the eyeballs (110) is provided with three first openings (120) equidistantly formed on its surface, each of the first openings (120) is internally provided with a pupil component (130) capable of expressing different eye expressions, each of the pupil components (130) further comprises an iris column (131) disposed inside the first opening (120), one end of each iris column (131) is printed with iris patterns (132), and a glass cover (133) that is tightly covered inside the first opening (120), and the two eyeballs (110) are fixedly connected by a penetrating rotating shaft (140);

a doll face component (200), wherein the surface of the doll face component (200) is provided with two second openings (210) in an eye area, the two second openings (210) are respectively sleeved on an outside of the two eyeballs (110), and the doll face component (200) is clampingly connected with the rotating shaft (140) through a clamping mechanism (220);

a bottom housing (300) is buckled and connected to a bottom of the doll face component (200).

2. The doll eye with a changeable pupil structure according to claim 1, wherein each of the iris columns (131) is opened with an insertion hole (134) at the other end, and each insertion hole (134) is fixedly connected to an insertion protrusion (121) at a bottom of each of the first opening (120).

3. The doll eye with a changeable pupil structure according to claim 1, wherein diameters of two ends of the rotating shaft (140) are different.

4. The doll eye with a changeable pupil structure according to claim 1, wherein the clamping mechanism (220) further comprises three first support bases (221) fixedly connected to an interior of the doll face component (200), each first support base (221) is provided with a first arc-shaped clamping groove (222), the rotating shaft (140) is connected with the three first arc-shaped clamping grooves (222) of the corresponding first support bases (221), the interior of the doll face component (200) is fixedly connected with three triangularly distributed positioning columns (223), one end of the three positioning columns (223) is provided with a pressure plate (224), one side of the pressure plate (224) is fixedly connected with three second support bases (225), each second support base (225) is provided with a second arc-shaped clamping groove (226), the second arc-shaped clamping grooves (226) are positioned opposite to the first arc-shaped clamping grooves (222) and are clamping connected with the rotating shaft (140), one side of the pressure plate (224) is fixedly connected with three plug pins (227), and the plug pins (227) are fixedly plugged into one end of the positioning columns (223).

5. The doll eye with a changeable pupil structure according to claim 1, wherein two T-shaped holes (310) are provided on two sides of a bottom of the bottom housing (300), and two T-shaped holes (310) are matched with two T-shaped plug pieces (230) fixedly connected to a bottom of the doll face component (200) at an ears position.

6. The doll eye with a changeable pupil structure according to claim 1, wherein a hemispherical protrusion is provided on each surface of a glass cover (133).

* * * * *